US005933700A

United States Patent [19]

Tilton

[11] Patent Number: 5,933,700

[45] Date of Patent: Aug. 3, 1999

[54] METHOD FOR MANUFACTURING PRESSURE SWIRL ATOMIZERS

[76] Inventor: Charles L Tilton, P.O. Box 8, Colton, Wash. 99113

[21] Appl. No.: 09/157,686

[22] Filed: Sep. 21, 1998

[51] Int. Cl.[6] ..... B22F 7/02

[52] U.S. Cl. ..... 419/6; 419/38

[58] Field of Search ..... 419/6, 38

[56] References Cited

U.S. PATENT DOCUMENTS

| | | | |
|---|---|---|---|
| 1,657,372 | 1/1928 | Danielsson | 419/6 |
| 1,869,869 | 8/1932 | Hewlett | 299/120 |
| 2,378,348 | 6/1945 | Wilmes | 299/120 |
| 2,593,884 | 4/1952 | Ifield | 299/120 |
| 3,692,245 | 9/1972 | Needham et al. | 239/485 |
| 4,080,700 | 3/1978 | Muller | 29/157 C |
| 4,087,050 | 5/1978 | Tsuji et al. | 239/490 |
| 4,586,226 | 5/1986 | Fakler et al. | 29/157 R |
| 5,092,039 | 3/1992 | Gaskell | 29/890.142 |
| 5,220,804 | 6/1993 | Tilton et al. | 62/64 |
| 5,435,884 | 7/1995 | Simmons et al. | 216/100 |
| 5,599,466 | 2/1997 | Maier et al. | 219/69.17 |
| 5,622,489 | 4/1997 | Monro | 431/187 |
| 5,768,103 | 6/1998 | Kobrinetz et al. | 361/699 |
| 5,860,602 | 1/1999 | Tilton et al. | 239/548 |

FOREIGN PATENT DOCUMENTS 60190593 9/1994 Japan .

*Primary Examiner*—Daniel J. Jenkins
*Attorney, Agent, or Firm*—David S. Thompson

[57] ABSTRACT

A method for manufacturing a spray plate includes the steps of making a plurality of layers from powdered metal, solidified by pressure between an appropriate upper die and lower die. The dies define appropriate holes required to form inlet ports, feed ports, swirl chamber or discharge apertures. Fluid pressure applied to the back side of the die flushes away green, unfired material in selected areas from each layer, thereby forming a layer having an array of swirl atomizer components. A multi-layered spray plate is assembled from a plurality of layers, which in a preferred version includes two to four layers, which are stacked so that the alignment features are in-line and associated atomizer components are aligned. The layers are then joined into a monolithic fused plate, by compacting and firing the layers.

2 Claims, 4 Drawing Sheets

FIG 70
80
35
24
25
23
34
36
43
53
32
31
30
24
25
23
20
22
21
200
33
43
53
52
50
51
42
41
40
200

METHOD FOR MANUFACTURING PRESSURE SWIRL ATOMIZERS

CROSS-REFERENCES

This application is related to an application filed Dec. 6, 1996 having Ser. No. 08/758,746.

BACKGROUND

Spray swirl atomizers have been produced by the assembly of a plurality of layers. U.S. Pat. No. 2,593,884, issued Apr. 22, 1952 to R. J. lfiled, is an example. Such a construction method allows each layer to have certain desired characteristics and spatial geometries. The assembly of the spray swirl atomizer requires the layers to be stacked in the appropriate order.

U.S. patent application Ser. No. 08/758,746 discloses the manufacture of a spray plate having an array of spray swirl atomizers. According to the teaching of this application, a plurality of atomizers are formed on a spray plate having a plurality of layers. The manufacturing process used to produce each layer typically involves chemical etching or machining. This allows the construction of the appropriated indentations or through holes in each layer so that when the layers are assembled together in a laminating process an array of pressure swirl atomizers having the desired characteristics results.

The manufacture of such layers for assembly into a spray plate can be difficult and expensive. The use of chemical etching or machining results in considerable manufacturing expenses. The process is generally too slow to be economical, and results in chemical waste that is environmentally hazardous.

Similarly, laser cutting, while faster than chemical etching, is also a slow process. Laser etching can also result in the formation of dross; i.e. a leftover metal which is partially oxidized, and is typically partially welded onto the layer. This can result in non-uniform holes, and the possibility of additional finishing work required to result in a plate of a preferred quality level.

Mechanical drilling is a further option where automated drilling machinery is available. The problems associated with this manufacturing method are also time and cost. It is also frequently necessary to remove burrs or other ragged imperfections from the layers before the layers are laminated, forming a spray plate.

What is needed is a method of manufacture which results in individual layers having indentations and through holes sized to exacting tolerances. The manufacturing method must allow for the production of high-volume, low-cost, high quality and precision, low-defect layers which can then be assembled into a spray plate having these characteristics.

SUMMARY

The present invention is directed to a method of manufacturing spray plates containing arrays of pressure swirl atomizers that satisfies the above needs. The method for manufacturing a spray plate having an array of pressure swirl atomizers of the present invention involves the steps of:

(A) Assembling each layer of a multi-layered spray plate, as follows:

(a) Loading a die with powdered metal material.

(b) Pressing the powdered metal, forming a green layer.

(c) Applying pressurized fluid to one side of the die, wherein the die defines openings associated with spray swirl atomizer components.

(d) Flushing away green material in selected areas from the green layer, thereby forming an array of swirl atomizer components.

(e) Forming alignment features, thereby allowing adjacent layers to be correctly aligned.

(B) Assembling a multi-layered spray plate from a plurality of layers, as follows:

(a) Stacking the layers so that the alignment features are adjusted.

(b) Adjoining the layers together.

(c) Firing the material, thereby curing it.

It is therefore a primary advantage of the present invention to provide a novel method for manufacturing pressure swirl atomizers that results in high-volume, low-cost, high-precision, low-defect spray plates having arrays of pressure swirl atomizers.

A further advantage of the present invention is to provide a novel method for manufacturing pressure swirl atomizers that results in the formation of many atomizers simultaneously in an extremely rapid, low-cost manufacturing process, without the need to slowly and at great expense manufacture each spray swirl atomizer component individually, and without the need to use slow and environmentally hazardous manufacturing methods.

Another advantage of the present invention is to provide a novel method for manufacturing pressure swirl atomizers that does not result in the environmental disadvantages of chemical etching processes, that does not require de-burring in a manner similar to mechanical drilling, and that does not result in oxidation or dross formation as is common in laser etching, due to the heat of the reaction.

DRAWINGS

These and other features, aspects, and advantages of the present invention will become better understood with regard to the following description, appended claims, and accompanying drawings where:

DESCRIPTION

Figure 1:
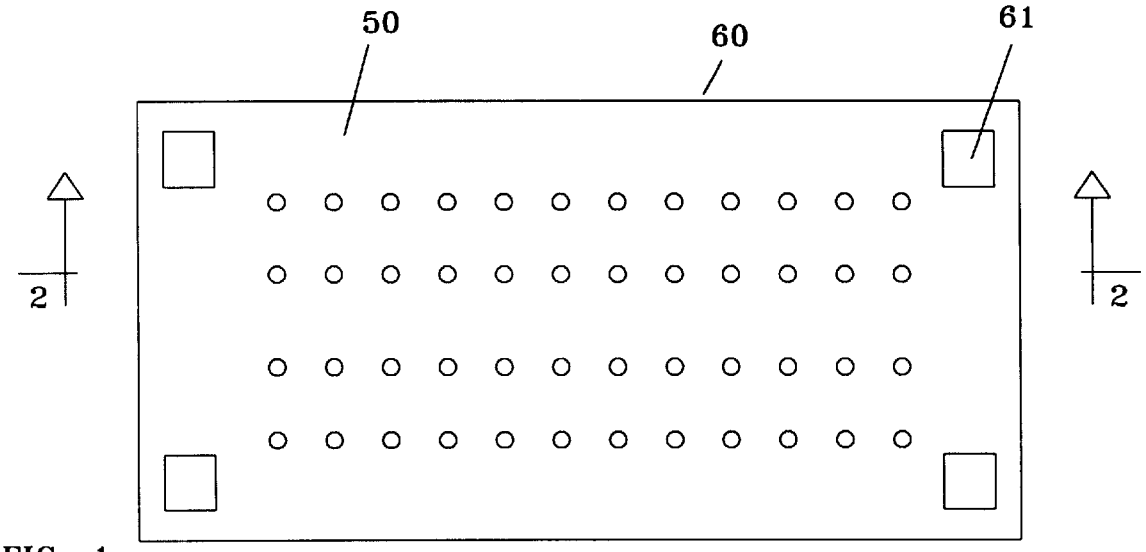
FIG. 1 is a orthographic view of a spray plate manufactured in a manner consistent with the method of the invention, showing the discharge apertures of an array of pressure swirl atomizers.

Referring in generally to FIGS. 1 through 7, the method for manufacturing a spray plate 10 in accordance with the principles of the invention may be understood. In a preferred version of the invention, a four-layer spray plate 10 comprises an inlet layer 20, a feed port layer 30, a swirl chamber layer 40 and a discharge aperture layer 50. Each layer is formed of powdered metal, solidified by pressure between upper and lower dies in a press. The dies define appropriate holes required to form inlet ports, feed ports, swirl chamber or discharge apertures. Fluid pressure applied to the back side of the die flushes away green, unfired material in selected areas from each layer, creating through holes and thereby forming a layer having an array of swirl atomizer components. A multi-layered spray plate is assembled from a plurality of layers, which in a preferred version includes the above four layers, which are stacked so that the alignment features are in-line and associated atomizer components are aligned. The layers are then joined into a fused plate 60, by adjoining and firing the layers.

Figure 3:
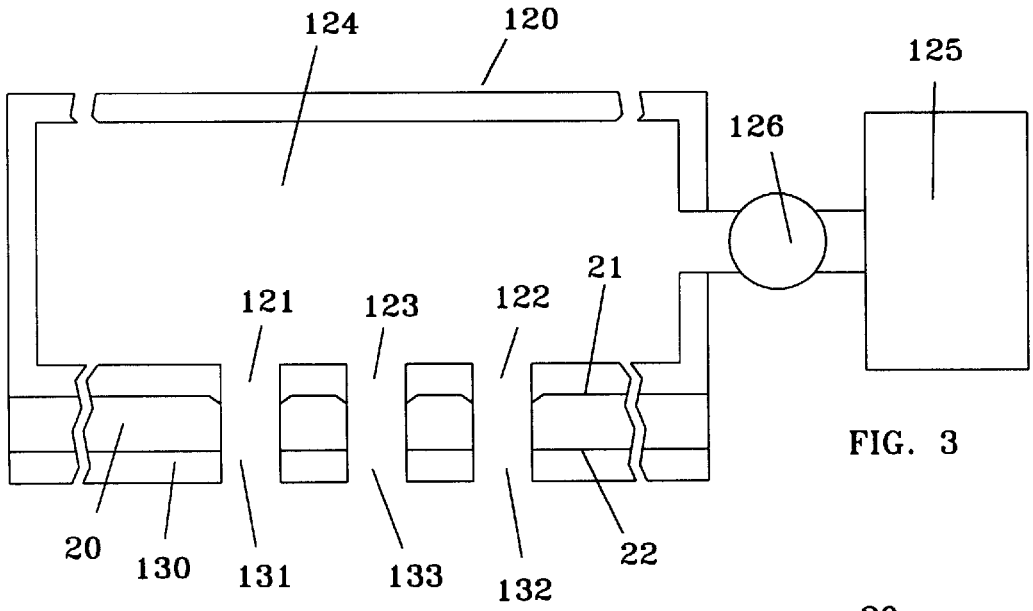
FIG. 3 is a cross-sectional view of an inlet layer under construction, between the inlet layer upper and lower dies.
Figure 3A:
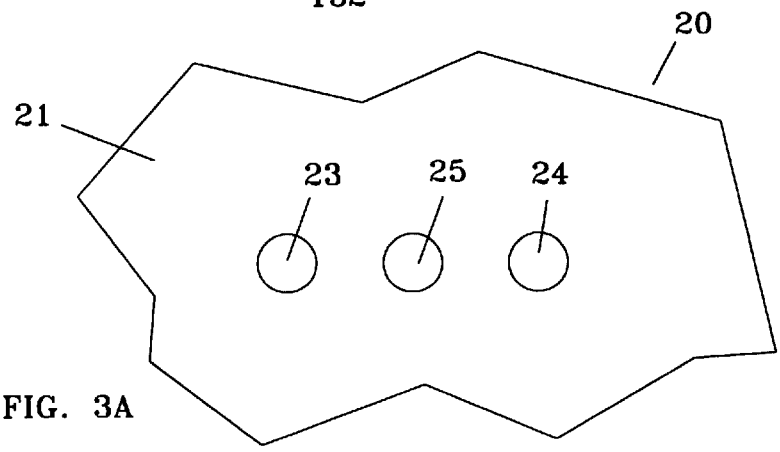
FIG. 3A is an orthographic view of the inlet layer after removal from the upper and lower dies.

Referring to FIGS. 3 and 3A, an inlet layer 20 is seen. In a preferred version of the inlet layer, upper and lower surfaces 21, 22 define an array of sets of left, right and center inlet holes 23, 24 and 25. These inlet holes are pressure swirl atomizer components which form the inlets of the spray swirl atomizers formed in the fused plate 60. In an alternative version of the invention, a greater or lesser number of inlet holes may be defined in the inlet layer, and therefore in the inlet layer upper and lower dies 120, 130. Similarly, in a preferred version the inlet layer is 0.020 inches thick, but the thickness may be adjusted, as needed, to result in the desired spray pattern.

As seen in FIG. 3, the inlet layer 20 is formed by pressing powdered metal between the inlet layer upper die 120 and inlet layer lower die 130, using a known press (not shown). The inlet layer upper die defines an array of at least one inlet producing passage, and in a preferred version defines an array of left, right and center inlet producing passages 121, 122, 123, which are sized to produce the array of left, right and center inlet holes 23, 24, 25 of the inlet layer.

The inlet layer lower die 130 similarly defines left, right and center inlet producing passages, 131, 132, and 133 which correspond to, and are aligned with, the inlet producing passages of the inlet layer die.

The inlet layer upper die 120 also defines a pressurized fluid reservoir 124 which may carry water, liquid, gas or other fluid. After the upper die 120 and lower die 130 have closed upon the powdered metal, pressurized fluid from reservoir 124 travels from the reservoir through a valve 126 into a plenum 125. The fluid passes from the plenum through passages 121, 122, 123, and through the corresponding passages 131, 132, 133 in the inlet layer lower die. This fluid movement flushes away green material (i.e. powdered metal) in and between the passages 121, 122, 123, 131, 132, and 133. As a result, an inlet layer having an array of sets of inlet holes 23, 24, 25 is produced. FIG. 3A illustrates a small portion of the inlet layer, showing one set of inlet holes out of an array of many such sets of inlet holes defined in a preferred inlet layer 20.

Figure 4:
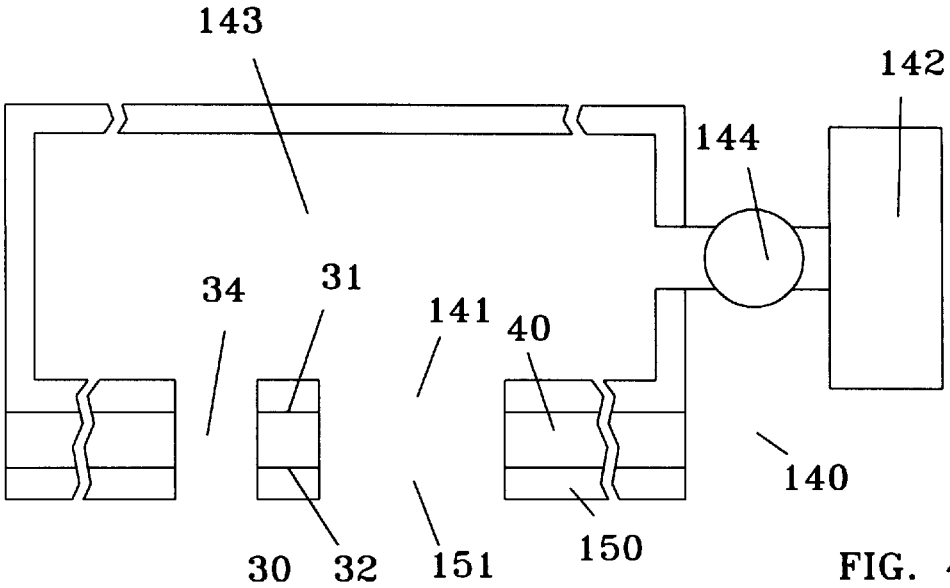
FIG. 4 is a cross-sectional view of a feed port layer under construction, between the feed port upper and lower layer dies.
Figure 4A:
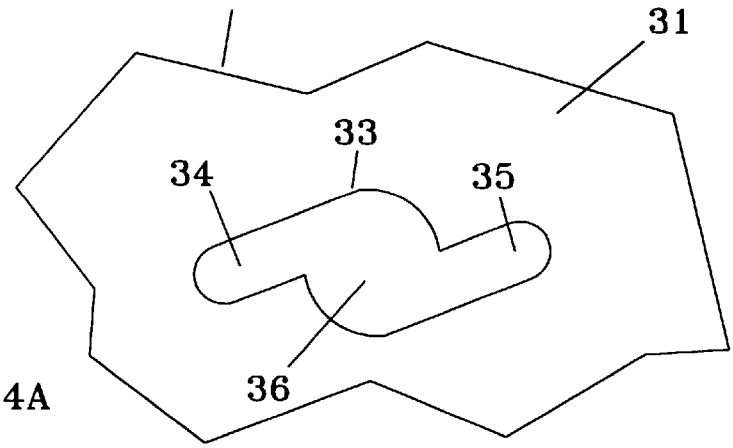
FIG. 4A is an orthographic view of the feed port layer after removal from the upper and lower dies.

Referring to FIGS. 4 and 4A, a feed port layer 30 is seen. In a preferred version of the feed port layer, upper and lower surfaces 31, 32 define an array of a feed ports 33, each feed port having left and right arms 34, 35. Each feed port is a pressure swirl atomizer component, which when assembled with other layers to form a spray plate, receives fluid from a set of inlet holes 23, 24, 25, imparts a radial acceleration to the fluid, and transfers the fluid to an associated swirler. In a preferred version the feed port layer is 0.020 inches thick, but the thickness may be adjusted, as needed, to result in the desired spray pattern.

As seen in FIG. 4, the feed port layer is formed by pressing powdered metal between the feed port layer upper die 140 and feed port layer lower die 150 using a press (not shown). The feed port layer upper die defines an array of feed port producing passages 141, which are sized to produce feed ports 33, which in turn are sized to mate with sets of left, right and center inlet holes 23, 24, 25 of the inlet layer.

The feed port layer lower die 150 similarly defines a feed port producing passage 151 which corresponds to, and is aligned with, the feed port producing passage of the feed port layer die.

The feed port upper layer die 140 also defines a pressurized fluid reservoir 142 which may carry water, liquid, gas or other fluid. After the feed port upper die 140 and feed port lower die 150 have closed upon the powdered metal, pressurized fluid from reservoir 142 travels from the reservoir through valve 144 and into the plenum 143. From the plenum, fluid flows into feed port producing passages 141, and through the corresponding passages 151 in the feed port layer lower die. This fluid movement flushes away green material (i.e. powdered metal) in and between the passages 141 and 151. As a result, a feed port layer 30 having an array feed ports 33 is produced. FIG. 4A illustrates a small portion of the feed port layer, having one feed port.

Figure 5:
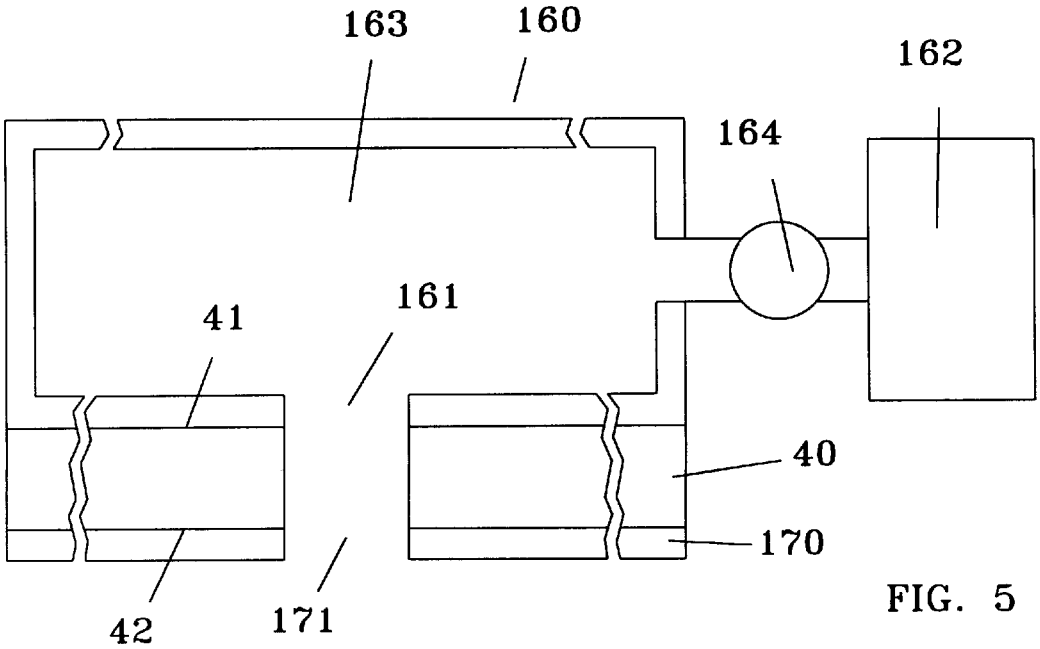
FIG. 5 is a cross-sectional view of a swirl chamber layer under construction, between the swirl chamber layer upper and lower dies.
Figure 5A:
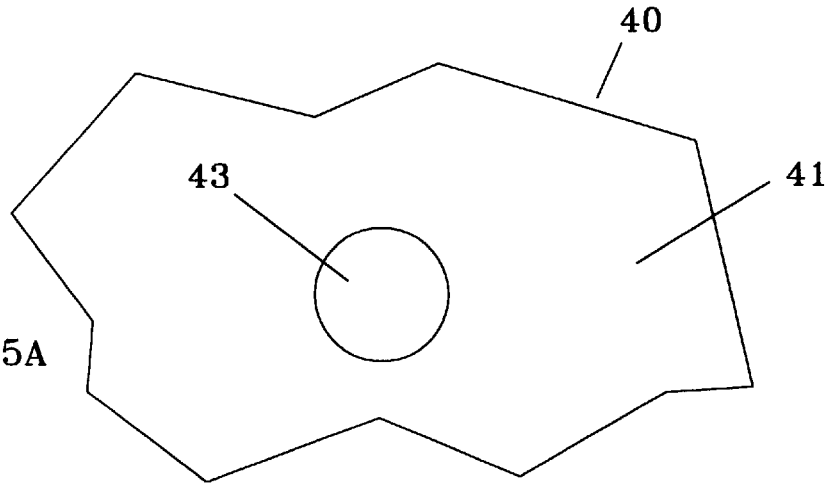
FIG. 5A is an orthographic view of the swirl chamber layer after removal from the upper and lower dies.

Referring to FIGS. 5 and 5A, a swirl chamber layer 40 is seen. In a preferred version of the swirl chamber layer, upper and lower surfaces 41, 42 define an array of a swirl chambers 43, each swirl chamber sized to mate with the upper swirl chamber 36 of an associated the feed port 30. Each swirl chamber is a pressure swirl atomizer component, which when assembled with other layers to form a spray plate, receives fluid from an associated feed port and delivers fluid to an associated discharge aperture. In a preferred version the swirl chamber layer is 0.035 inches thick, but the thickness may be adjusted, as needed, to result in the desired spray pattern.

As seen in FIG. 5, the swirl chamber layer is formed by pressing powdered metal between the feed swirl chamber upper die 160 and swirl chamber layer lower die 170. The swirl chamber layer die defines an array of swirl chamber producing passages 161, which are sized to produce swirl chambers 43, which in turn are sized to mate with the upper swirl chambers 36 of associated feed ports 33 of the feed port layer.

The swirl chamber layer lower die 170 similarly defines an array of swirl chamber producing passages 171 which corresponds to, and are aligned with, the swirl chamber producing passages of the swirl chamber layer die.

The swirl chamber layer die 160 also defines a pressurized fluid reservoir 162 which may carry water, liquid, gas or other fluid. After the upper and lower dies 160, 170 have closed upon the powdered metal, pressurized fluid from reservoir 162 travels from the reservoir through a valve 164 into a plenum 163. The fluid then passes from the plenum 163 through passages 161 in the upper die 160, and through the corresponding passages 171 in the swirl chamber layer lower die. This fluid movement flushes away green material (i.e. powdered metal) in and between the passages 161 and 171. As a result, a swirl chamber layer 40 having an array swirl chambers 43 is produced. FIG. 5A illustrates a small portion of the swirl chamber layer, having one swirl chamber.

Figure 6:
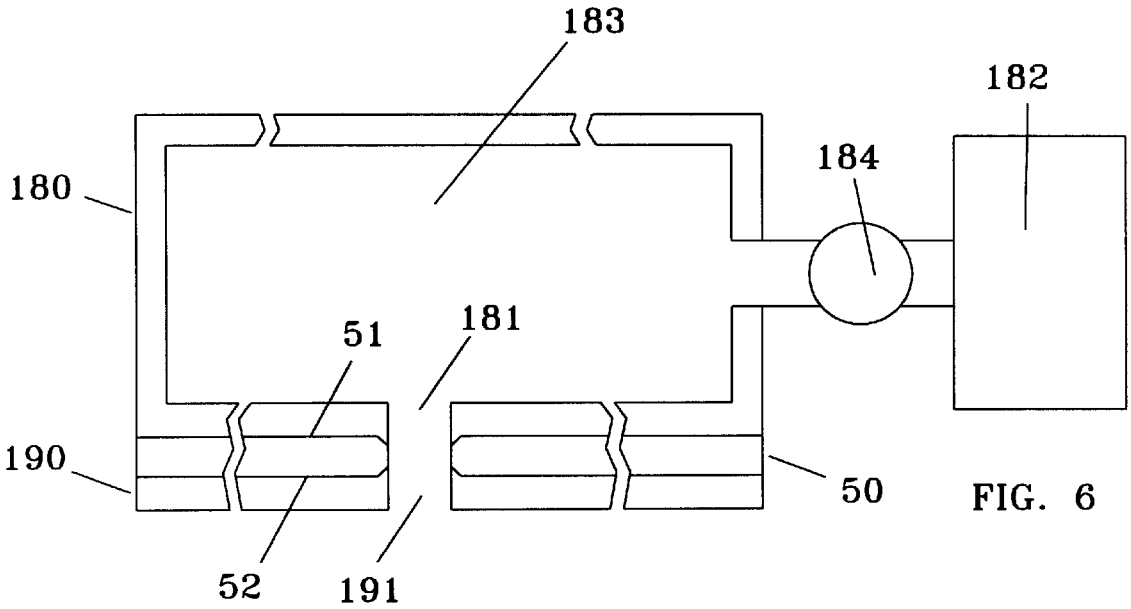
FIG. 6 is a cross-sectional view of a discharge aperture layer under construction, between the discharge aperture layer upper and lower dies.
Figure 6A:
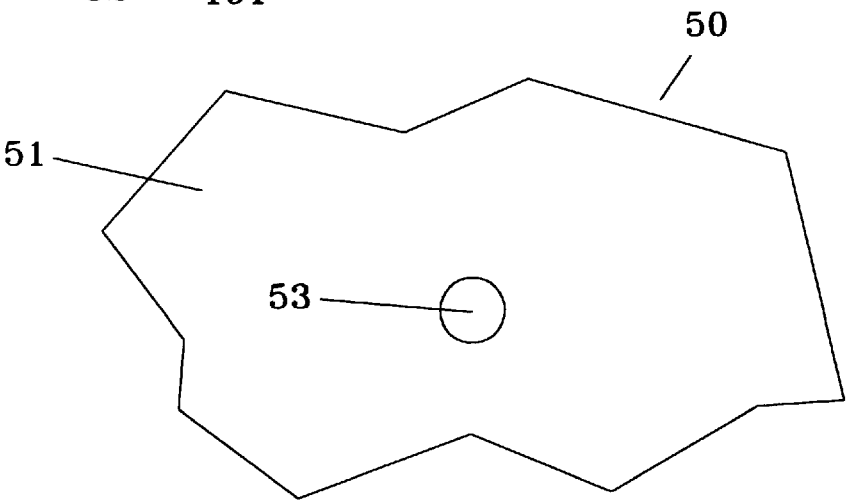
FIG. 6A is an orthographic view of the discharge aperture layer after removal from the upper and lower dies.

Referring to FIGS. 6 and 6A, a discharge aperture layer 50 is seen. In a preferred version of the discharge aperture layer, upper and lower surfaces 51, 52 define an array of a discharge apertures 53, each discharge aperture sized to produce a desired spray cone. Each discharge aperture is a pressure swirl atomizer component, which when assembled with other layers to form a fused plate 60, receives fluid from an associated swirl chamber 43 and discharges fluid from the spray plate in a generally cone-shaped pattern. In a preferred version the discharge aperture layer is 0.020 inches thick, but the thickness may be adjusted, as needed, to result in the desired spray pattern.

As seen in FIG. 6, the discharge aperture layer is formed by pressing powdered metal between the discharge aperture upper die 180 and discharge aperture layer lower die 190. The discharge aperture layer upper die defines an array of discharge aperture producing passages 181, which are sized to produce a discharge aperture 53, which in turn is sized to produce the desired spray cone.

The discharge aperture layer lower die 190 similarly defines a discharge aperture producing passage 191 which corresponds to, and is aligned with, the discharge aperture producing passage of the discharge aperture layer die.

The discharge aperture layer die 180 also defines a pressurized fluid reservoir 182 which may carry water, liquid, gas or other fluid. After the upper and lower dies 180, 190 have closed upon the powdered metal, pressurized fluid from reservoir 182 travels from the reservoir through a valve 184 into a plenum 183. The fluid then passes from the plenum 183 through passages 181 in the upper die 180, and through the corresponding passages 191 in the discharge aperture layer lower die 190. This fluid movement flushes away green material (i.e. powdered metal) in and between the passages 181 and 191. As a result, a discharge aperture layer having an array of discharge apertures 53 is produced. FIG. 6A illustrates a small portion of the discharge aperture layer, having one discharge aperture.

Figures 2, 7:
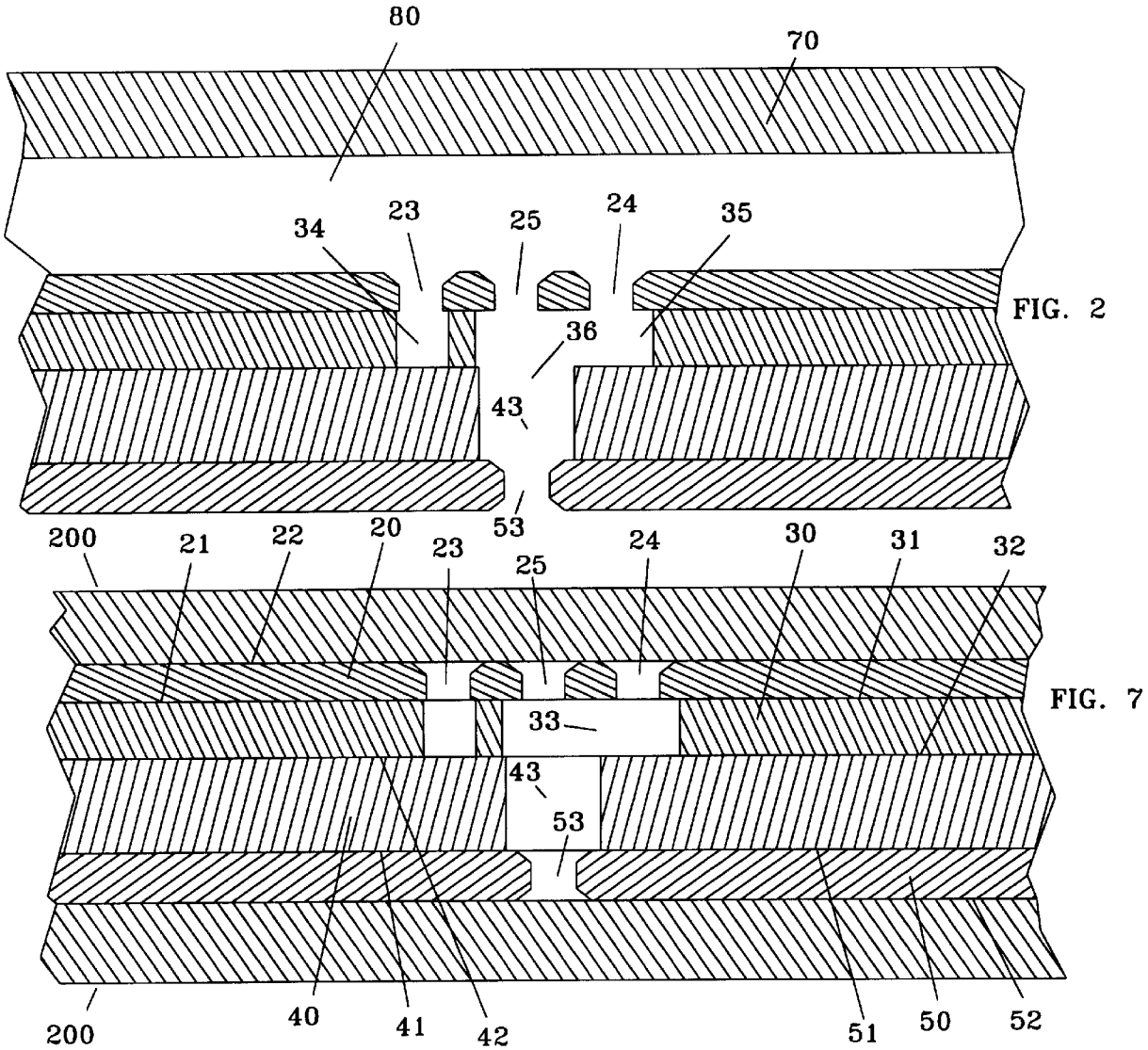
FIG. 2 is a cross-sectional view of a portion of a spray plate of FIG. 1, showing the relationship of the layers of the spray plate.
FIG. 7 is a cross-sectional view of the inlet, feed port, swirl chamber, and discharge aperture layers of FIGS. 3–6 being pressed into a single fused spray plate.

As seen in FIG. 7, a layer-joining press 200 having upper and lower plates is used to fuse together the a plurality of layers into a fused plate 60. The layers 20, 30, 40, 50 are first aligned by means of alignment guides 61 formed in each of the layers. Once aligned, the atomizer components in each layer are lined-up with associated atomizer components in adjacent layer(s).

Pressure is then applied, compacting the layers into a fused plate 60. The fused plate 60 may then be joined to a sintered metal filter 70, as seen in FIG. 2. Impurities are removed from fluid moving through the sintered metal filter and entering a fluid passage 80 adjacent to the inlet layer 20 of the fused spray plate 60.

While the above description concerns a preferred four-layer fused plate 60, it is clear that a spray plate could also be assembled from one or more layers formed of powdered metal solidified by pressure between upper and lower dies defining one or more passages. Where at least two layers were used, the at least two layers could be fused together to form a fused layer 60. In such a circumstance, some or all of the characteristics of the atomizer components would be defined in the single layer, or divided between the two or more layers.

Where desired, portions of the atomizer components can be created by the formation of thin areas in the layer, rather than through holes. Such thin areas can be formed by indentations in the layer. When such indentations were fused to a layer having a flat adjacent surface, the indentation could form a passageway for fluid flow within the atomizer.

Where desired, the fluid reservoirs 124, 142, 162, 182 may be combined for economy and simplicity.

The previously described versions of the present invention have many advantages, including a primary advantage of providing a novel method for manufacturing pressure swirl atomizers that results in high-volume, low-cost, high-precision, low-defect spray plates having arrays of pressure swirl atomizers.

A further advantage of the present invention is to provide a novel method for manufacturing pressure swirl atomizers that results in the formation of many atomizers simultaneously in an extremely rapid, low-cost manufacturing process, without the need to slowly and at great expense manufacture each spray swirl atomizer component individually, and without the need to use slow and environmentally hazardous manufacturing methods.

Another advantage of the present invention is to provide a novel method for manufacturing pressure swirl atomizers that does not result in the environmental disadvantages of chemical etching processes, that does not require de-burring in a manner similar to mechanical drilling, and that does not result in oxidation or dross formation as is common in laser etching, due to the heat of the reaction.

Although the present invention has been described in considerable detail and with reference to certain preferred versions, other versions are possible. For example, while the typically required steps of the method to manufacture an array of pressure swirl atomizers is disclosed, it is clear that slight variation in the materials used could result in slight variations in the method of manufacture. Similarly, while alignment features are typically defined in the surface of each layer, it is clear that the edges of each layer could be used as an alignment feature, and the layers could be stacked so that their edges were aligned.

Similarly, while the use of fluid to flush away green material is preferred, in an alternative embodiment of the invention the green material could be removed by mechanical means, such as pressure by pins or other instruments. For example, a plate holding at least one mechanical element, such as a pin, could be pressed against the discharge aperture upper and lower dies 180, 190, whereby the at least one pin would momentarily pass through the discharge producing passages 181, 191, thereby removing the green material in a manner that produces at least one discharge aperture 53 in a discharge aperture layer 50.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of manufacturing a spray plate having at least one layer and at least one pressure swirl atomizer, comprising:

(A) loading a die with powdered metal material, wherein the die defines an array of passages which are sized to produce pressure swirl atomizer components;

(B) pressing the powdered metal material, forming a green layer; and (C) removing green material from the green layer, in selected areas of the green layer which are adjacent to the passages sized to produce pressure swirl atomizer components, thereby forming an array of swirl atomizer components.

2. A method of manufacturing a spray plate having at least two layers and at least one pressure swirl atomizer, comprising:

(A) loading a die with powdered metal material, wherein the die defines an array of passages sized to produce pressure swirl atomizer components;

(B) pressing the powdered metal material, forming a green layer;

(C) forming alignment features, thereby allowing adjacent layers to be correctly aligned;

(D) applying pressurized fluid to the die;

(E) flushing away green material, from the green layer, in selected areas of the green layer which are adjacent to the passages sized to produce pressure swirl atomizer components, thereby forming an array of swirl atomizer components;

(F) stacking the layers so that the alignment features are adjusted;

(G) compacting the layers together; and (H) firing the material, thereby curing it.

* * * * *